US006430962B2

(12) United States Patent
Miura et al.

(10) Patent No.: US 6,430,962 B2
(45) Date of Patent: Aug. 13, 2002

(54) PRODUCTION METHOD FOR OXYGEN

(75) Inventors: Shinichi Miura; Masayuki Tanaka, both of Osaka; Koji Noishiki; Shuhei Natani, both of Takasago, all of (JP)

(73) Assignee: Kabushiki Kaisha Kobe Seiko Sho., Kobe (JP)

( * ) Notice: Subject to any disclaimer, the term of this patent is extended or adjusted under 35 U.S.C. 154(b) by 0 days.

(21) Appl. No.: 09/784,144

(22) Filed: Feb. 16, 2001

(30) Foreign Application Priority Data

Feb. 23, 2000 (JP) ..... 2000-045917

(51) Int. Cl.[7] ..... F25J 3/00
(52) U.S. Cl. ..... 62/654; 62/648
(58) Field of Search ..... 62/50.2, 643, 654, 62/648

(56) References Cited

U.S. PATENT DOCUMENTS 4,555,256 A 11/1985 Skolaude et al.
5,275,003 A 1/1994 Agrawal et al.
5,329,776 A 7/1994 Grenier
5,386,692 A 2/1995 Laforce
5,467,602 A 11/1995 Paolino
5,564,290 A * 10/1996 Bonaquist et al. ..... 62/646
5,592,832 A * 1/1997 Herron et al. ..... 62/646
5,735,142 A 4/1998 Grenier
5,765,397 A 6/1998 Honda et al.
5,931,021 A 8/1999 Shnaid et al.
6,110,980 A 8/2000 Chen

FOREIGN PATENT DOCUMENTS

EP 0 707 700 4/1995
FR 2688052 3/1992 ..... F25J/3/04

* cited by examiner

*Primary Examiner*—Denise L. Esquivel
*Assistant Examiner*—Malik N. Drake

(57) ABSTRACT

In a production method for oxygen, liquid oxygen is taken out from a rectification column of an air separation unit, and is compressed by a pump so that the pressure thereof exceeds the critical pressure. Then, the oxygen is led into a heat exchanger and is heated therein so that the temperature of the oxygen exceeds the critical temperature.

20 Claims, 5 Drawing Sheets

PRODUCTION METHOD FOR OXYGEN

BACKGROUND OF THE INVENTION

1. Field of the Invention

The present invention relates to a production method for oxygen, in which high-pressure oxygen gas is produced by compressing and heating liquid oxygen which is obtained by cryogenic distillation, etc.

2. Description of the Related Art

In a typical production method for high-pressure oxygen, low-pressure oxygen is first obtained, and is then compressed using an oxygen compressor.

With this method, however, there is a safety hazard in that reactivity between the oxygen and the material of the compressor will be high since the temperature of the oxygen is increased by the heat from the compression. In addition, maintenance costs, as well as cost for equipment, are high.

On the other hand, to avoid this, another method is also known in which liquid oxygen obtained by an air separation unit is compressed, and is then heated by a heat exchanger.

Conventionally, in this method, the liquid oxygen is compressed by a pump and is then evaporated by exchanging heat with hot stream, for example, compressed raw air, in a brazed aluminum plate-fin heat exchanger. This method will be referred to as a conventional compression method in the following descriptions.

The brazed aluminum plate-fin heat exchanger provides excellent heat conductivity and may be used for multiple fluids. In addition, the equipment is compact relative to the heating area thereof and can be provided at low cost. Accordingly, the brazed aluminum plate-fin heat exchanger is a key piece of hardware in the conventional compression method.

The brazed aluminum plate-fin heat exchanger, however, is not sufficiently resistant to cyclic stress because of its brazed construction. From the viewpoint of protecting the brazed aluminum plate-fin heat exchanger, it is necessary to reduce the amount of stress which occurs therein. Thus, the brazed aluminum plate-fin heat exchanger has not been used in process to produce high-pressure oxygen.

Accordingly, when high-pressure oxygen is required, the conventional compression method is used to increase the pressure of the oxygen to 3.5 MPa at most, and further compression is performed by the oxygen compressor.

As a result, the amount of stress that occurs in the heat exchanger is reduced; however, since the oxygen compressor is used, the above-described problems of safety hazards and high cost remain. Accordingly, there has been a demand to solve such problems.

SUMMARY OF THE INVENTION

Accordingly, it is an object of the present invention to provide a production method for oxygen, in which the conventional compression method which is advantageous regarding cost is used, and in which thermal stress occurs in the heat exchanger is reduced, so that the pressure of the oxygen may be safely increased to a desired level.

According to a production method for oxygen of the present invention, liquid oxygen is compressed so that the pressure thereof exceeds the critical pressure, and is then drawn into a plate-fin heat exchanger as cold stream. The liquid oxygen is heated in the plate-fin heat exchanger so that the temperature thereof exceeds the critical temperature and is then taken out from the plate-fin heat exchanger.

According to the method, the pressure of the liquid oxygen, which signifies oxygen-rich liquid, is increased to exceed the critical pressure (5.043 MPa). The liquid oxygen is then led into the plate-fin heat exchanger, which may be brazed aluminum plate-fin heat exchanger, in which the temperature thereof is increased to exceed the critical temperature. Thus, the oxygen becomes a supercritical fluid in the heating process, and a phase change in the oxygen does not occur in the heat exchanger.

To describe this more specifically with reference to FIG. 2, when cold stream A, in which the pressure is lower than the critical pressure, is heated, there is a state in which the fluid A evaporates while the temperature thereof does not change much due to the latent heat.

In contrast, when cold stream B, in which the pressure is higher than the critical pressure, is heated, there is no boiling point or the latent heat, so that the fluid B becomes a supercritical fluid. In supercritical fluids, there is no evaporation, so that phase change does not occur. Thus, the temperature of cold stream B smoothly increases along with the amount of the heat with the hot stream.

The temperature profile inside the heat exchanger is determined by the temperature of each fluid. As shown in FIG. 3, when the pressure of the cold stream is lower than the critical pressure, the temperature difference between the cold stream and the hot stream is large. Accordingly, there is a risk that the difference in amounts of heat shrinkage between members of the heat exchanger will cause a great amount of thermal stress so as to damage the heat exchanger.

On the other hand, as shown in FIG. 4, with the fluid in which the pressure is higher than the critical pressure, the temperature difference $\Delta t$ is small, so that the thermal stress is also small. Thus, even a relatively weak heat exchanger may be used.

Accordingly, the conventional compression method which is advantageous regarding cost may be used while the safety of the heat exchanger, for example, a brazed aluminum plate-fin heat exchanger, is ensured, and the desired high-pressure oxygen will still be obtained.

Especially when the pressure of the liquid oxygen is higher than 8.049 MPa, which far exceeds the critical pressure, stable operation is realized since the operating pressure is higher than the pressure loss in the system. Accordingly, the supercritical fluid is more stable, so that the effect of reducing stress in the heat exchanger is enhanced.

The flow rate of the oxygen in the heat exchanger is preferably not more than 5 m/sec which is the standard flow rate for safety (the lower limit is 0.5 m/sec). Accordingly, the heat exchange of the oxygen is safely performed.

In addition, the temperature difference between hot stream and cold stream in the heat exchanger is preferably not more than 20° C. Accordingly, the stress occurs in the heat exchanger is reduced.

As described above, thermal stress is not caused by a phase change in the heat exchanger. Thus, even when a load change occurs due to, for example, differences in oxygen flow rates between day and night, the heat exchanger may be sufficiently resistant against stress occurs therein.

Accordingly, the heat exchanger may be continuously operated safely even under conditions in which a relatively high degree of load variation occurs.

The liquid oxygen which is to undergo the compression and heating process may be obtained by the air separation unit. In such a case, high-pressure oxygen is obtained in one of the processes (a process of increasing internal pressure)

performed in the air separation unit, so that no additional equipment is required. Accordingly, the cost of equipment may be reduced, and oxygen may be produced at higher efficiency and at lower cost.

Raw air required as a material in the air separation unit is preferably compressed so that the pressure thereof exceeds the critical pressure. In addition, the balance between the pressure and the flow rate of the raw air is preferably adjusted before it is used. Accordingly, the temperature difference between the raw air and cold stream, in which the pressure is higher than the critical pressure, may be extremely low. Thus, the amount of local stress may be extremely small.

DESCRIPTION OF THE PREFERRED EMBODIMENT

Figure 1:
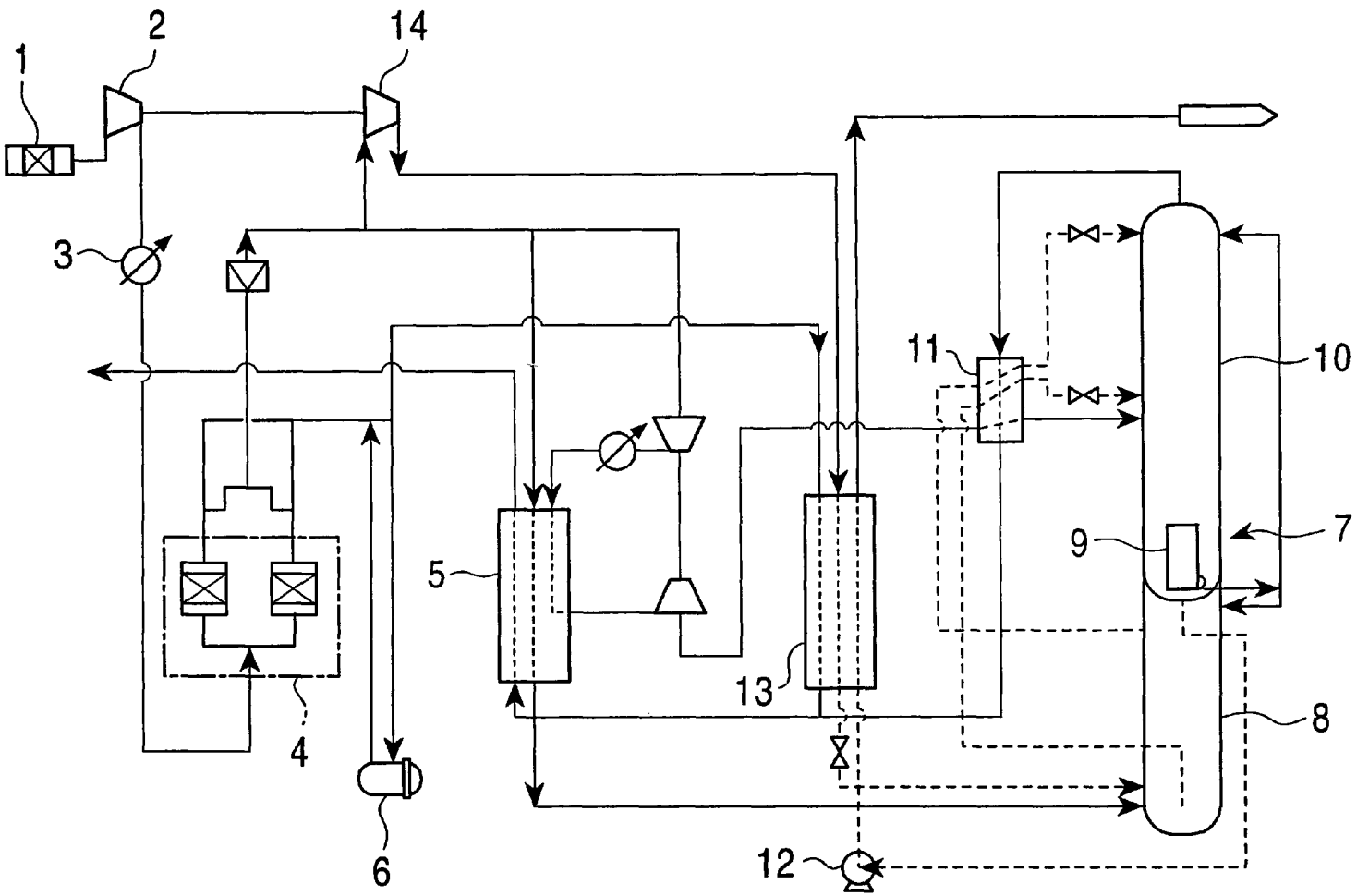
FIG. 1 is a flow diagram of an air separation unit of the present invention.
Figure 2:
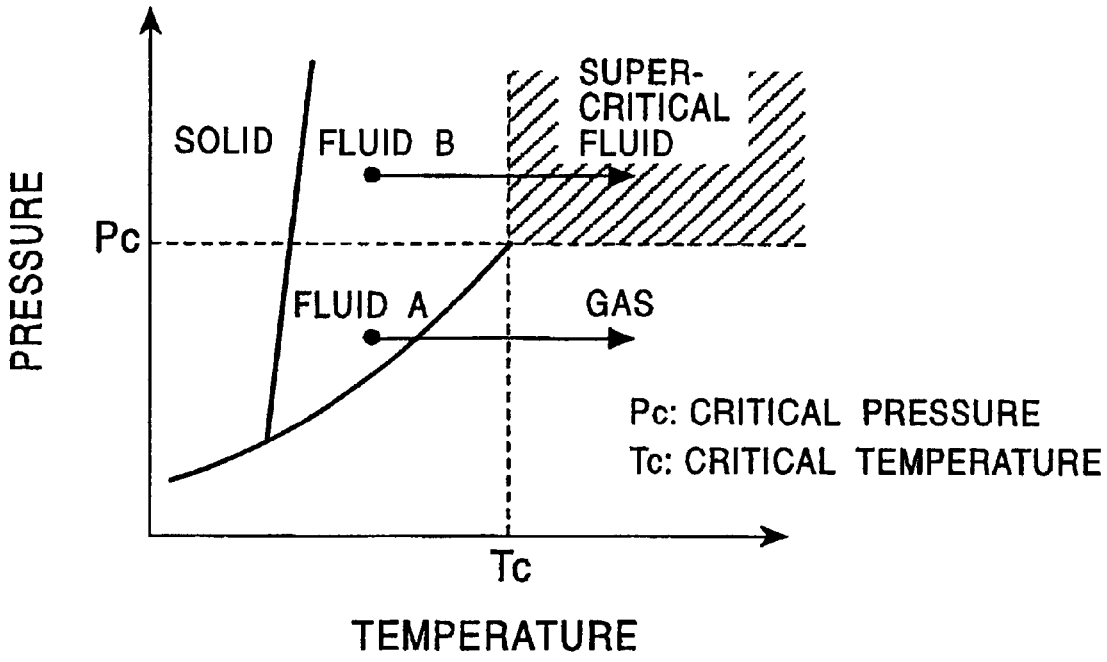
FIG. 2 is a graph which shows relationships between temperature and pressure of fluids in the heat exchanger.

FIG. 1 shows a process flow according to an embodiment of the present invention.

In the present embodiment, high-pressure oxygen is obtained in one of the processes (a process of increasing internal pressure) performed in an air separation unit.

First, an overall construction and operation of the air separation unit will be explained below.

Raw air is filtered by a raw air filter 1, is compressed in a raw air compressor 2 so that the pressure thereof is increased to a desired value, and is cooled in a precooler 3. Impurities such as moisture, etc., are removed in an adsorber 4, and the raw air is then led into a main heat exchanger 5 which is disposed in a cold box. A regenerated gas heater 6 is also provided in the air separation unit.

The temperature of the raw air is reduced approximately to the dew point thereof by the main heat exchanger 5. The raw air is then led into a high-pressure column (lower column) 8 of a rectification column 7, in which the raw air moves upward while contacting with liquid reflux, so that the concentration of nitrogen therein is increased. Accordingly, nitrogen gas containing a small amount of oxygen is taken out from the upper section of the high-pressure column 8 and is led into a main condenser 9, in which heat exchange between the nitrogen gas and liquid oxygen is performed. The nitrogen gas is condensed during the heat exchanging process, and is resupplied into the upper section of the high-pressure column as the liquid reflux.

A part of the liquid nitrogen in the upper section of the high-pressure column 8 is taken out therefrom, is supercooled in a supercooler 11, and is then depressurized and is led into a low-pressure column 10.

Similarly, the liquid air in the lower section of the high-pressure column 8 is taken out, is supercooled, and is then depressurized and led into the low-pressure column 10.

In the low-pressure column 10, rectification is performed in a similar manner as in the high-pressure column 8, wherein the upper section is nitrogen-rich, and the lower section is oxygen-rich.

The nitrogen in the upper section of the low-pressure column 10 is obtained in a gaseous state, and is supplied to a low-temperature side of the main heat exchanger 5. The nitrogen is heated in the main heat exchanger 5 so that the temperature thereof is increased to atmospheric temperature, and it is taken out as product nitrogen.

Next, an oxygen production process which is one of the processes performed in the air separation unit will be explained below.

The oxygen obtained by the above-described rectifying process is taken out from the lower section of the low-pressure column 10 in a liquid state (oxygen-rich liquid). Then, the liquid oxygen is pressurized by a pump 12 so that the pressure thereof exceeds 5.043 MPa, which is the critical pressure, and is then led into an oxygen heat exchanger 13, which is an aluminum-brazing plate-fin heat exchanger.

A part of the raw air is compressed by a booster compressor 14 so that the pressure thereof is increased to a predetermined value, and is supplied to the oxygen heat exchanger 13 as hot stream. At this time, the pressure of the raw air is set to an adequate value for the heat exchange performed in the oxygen heat exchanger 13, which is preferably higher than the critical pressure. Then, the heat exchange is performed between this raw air and the high-pressure oxygen in which the pressure is increased to exceed the critical pressure as described above.

In this heating process, the temperature of the high-pressure oxygen is increased to exceed the critical temperature, so that the oxygen becomes a supercritical fluid. Accordingly, the high-pressure oxygen is taken out from the oxygen heat exchanger 13 as a high-pressure oxygen product.

As described above, the pressure of the liquid oxygen obtained from the rectification tower 7 is increased to exceed the critical pressure, and then the temperature thereof is increased in the oxygen heat exchanger, so that the oxygen becomes a supercritical fluid. Thus, phase change of the oxygen does not occur in the oxygen heat exchanger 13.

Accordingly, stress variation due to the phase change of the oxygen also does not occur in the oxygen heat exchanger 13. Thus, the oxygen heat exchanger 13 may be sufficiently resistant to stress variation due to other reasons, for example, differences in flow rates between day and night.

Figure 3:
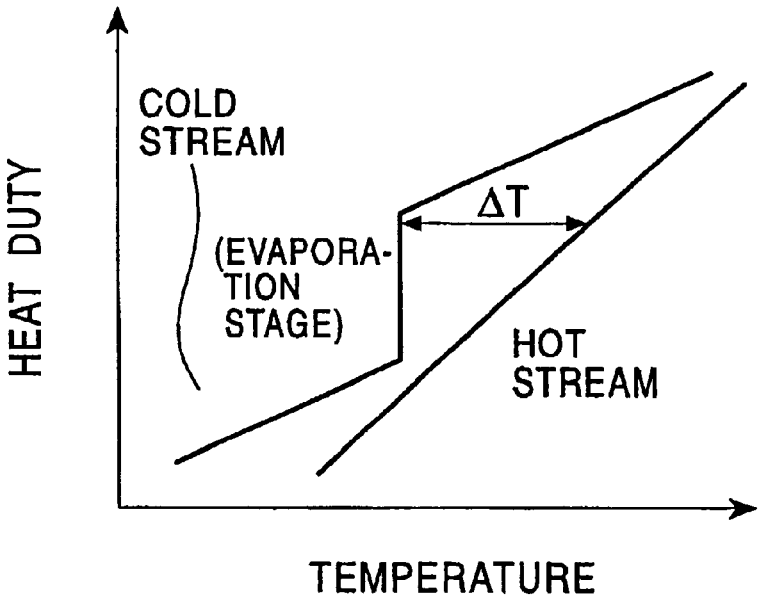
FIG. 3 is a graph which schematically shows relationships between temperature and heat duty between fluids in the heat exchanger, in which the pressure of cold stream is lower than the critical pressure.
Figure 4:
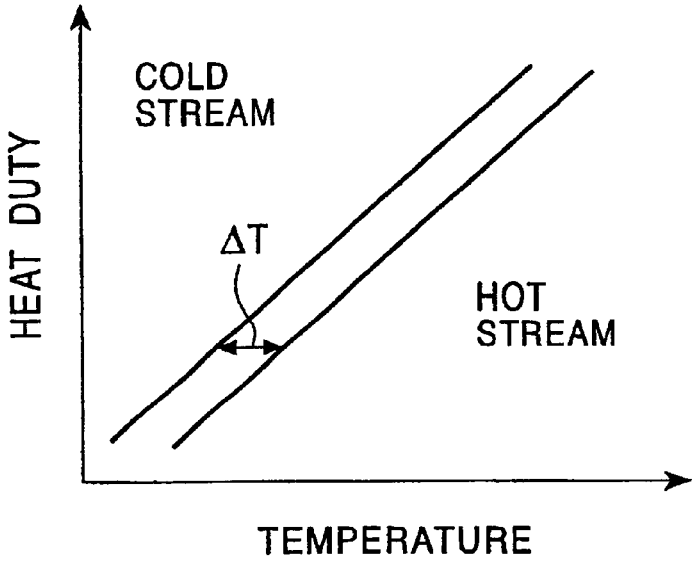
FIG. 4 is a graph which schematically shows relationships between temperature and heat duty between fluids in the heat exchanger, in which the pressure of cold stream is higher than the critical pressure.

Relationships between temperature and heat duty, which are schematically shown in FIG. 3 and FIG. 4, will be more specifically explained below.

Figure 5:
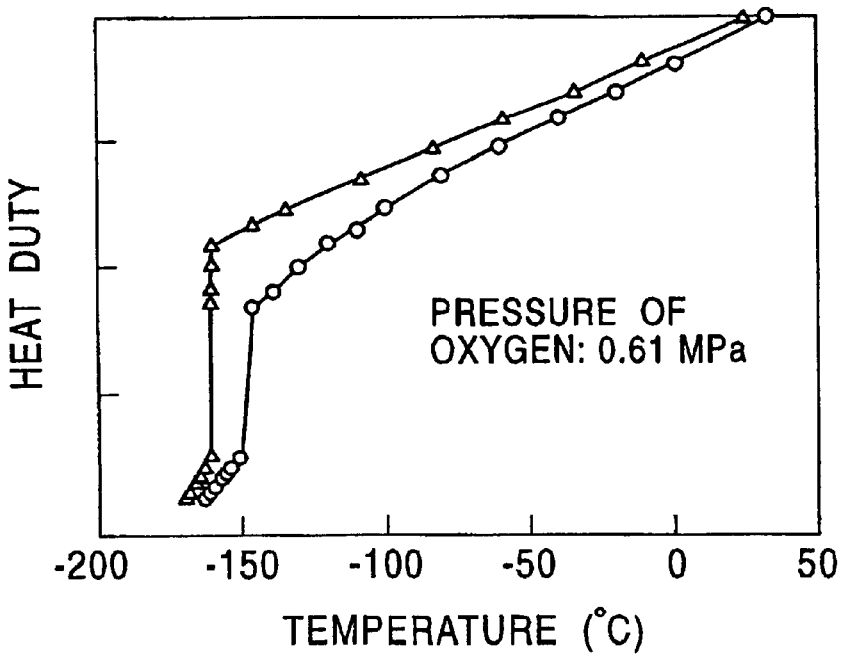
FIG. 5 is a graph which specifically shows the relationships between temperature and heat duty between fluids, in which the pressure of the oxygen is 0.61 MPa.
Figure 6:
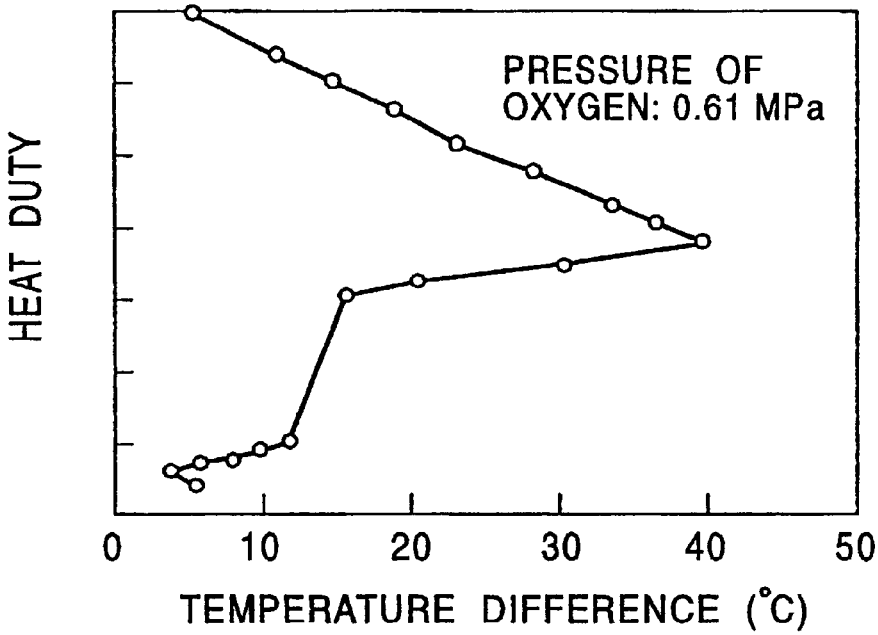
FIG. 6 is a graph which specifically shows the relationship between temperature difference and heat duty between the fluids, in which the pressure of the oxygen is 0.61 MPa.

According to experiments performed by the inventors, when the liquid oxygen in which the pressure was lower than the critical pressure (0.61 MPa) occurred, the temperature difference between cold stream (marked by triangles) and hot stream (marked by circles) was large, as shown in FIG. 5 and FIG. 6. In this case, the maximum temperature difference was 40° C.

Figure 7:
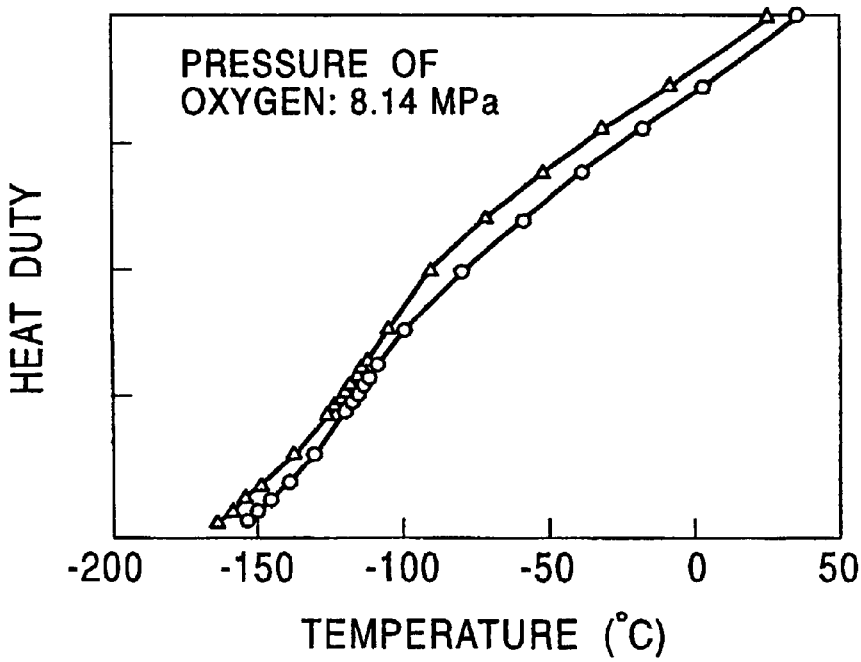
FIG. 7 is a graph which specifically shows the relationships between temperature and heat duty between fluids, in which the pressure of the oxygen is 8.14 MPa.
Figure 8:
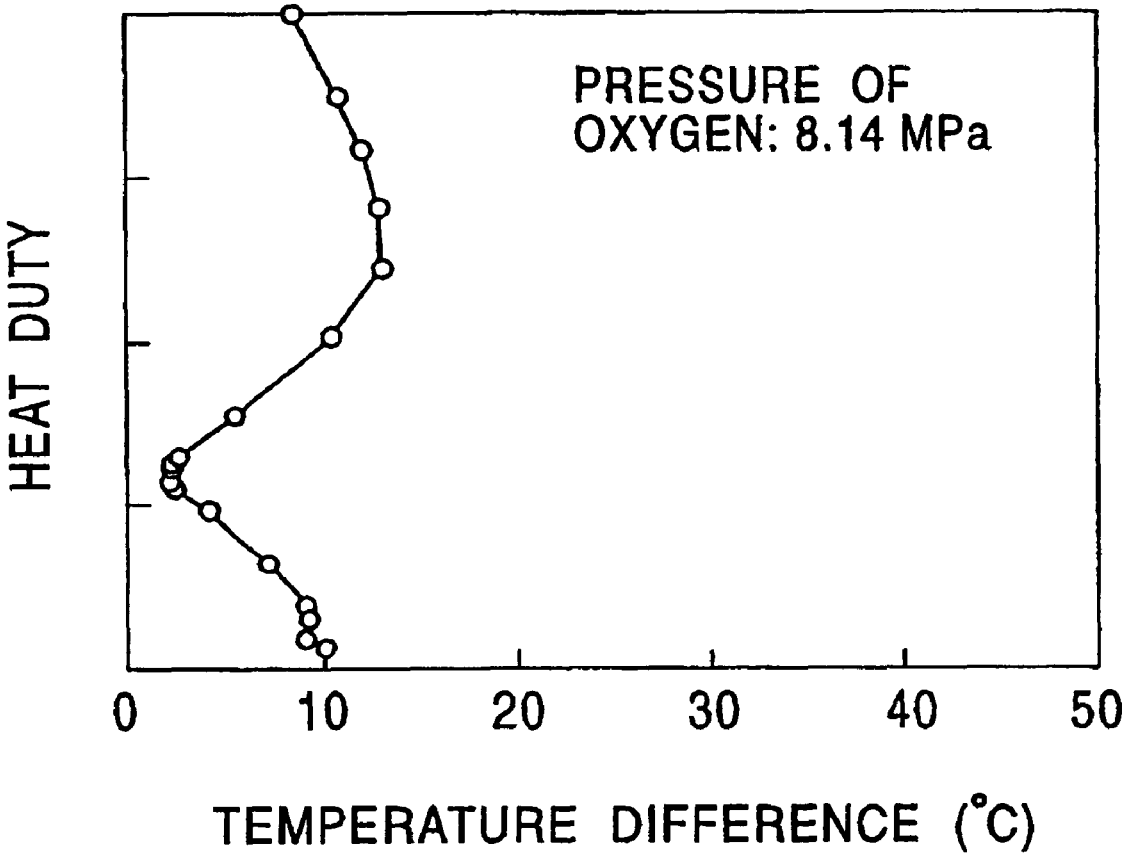
FIG. 8 is a graph which specifically shows the relationship between temperature difference and heat duty between the fluids, in which the pressure of the oxygen is 8.14 MPa.

In contrast, when the liquid oxygen in which the pressure was higher than the critical pressure (8.14 MPa) was used, the temperature difference was 12° C. at maximum, as shown in FIGS. 7 and 8. Accordingly, the temperature difference was approximately one third compared to the case in which the low-pressure oxygen was used.

What is claimed is:

1. A production method for oxygen, comprising the steps of:

compressing liquid oxygen so that the pressure of the liquid oxygen exceeds the critical pressure;

supplying the compressed liquid oxygen into a plate-fin heat exchanger as cold stream; and heating the supplied liquid oxygen in said plate-fin heat exchanger so that the temperature of the oxygen exceeds the critical temperature, and taking out the oxygen from said plate-fin heat exchanger, wherein said plate-fin heat exchanger is a brazed aluminum plate-fin heat exchanger.

2. A production method for oxygen according to claim 1, wherein liquid oxygen obtained in a rectification column of an air separation unit is taken out from the rectification column and is compressed so that the pressure of the liquid oxygen exceeds the critical pressure.

3. A production method for oxygen according to claim 1, wherein a flow rate of the oxygen in said plate-fin heat exchanger is in a range of 0.5 m/sec to 5 m/sec.

4. A production method for oxygen according to claim 1, wherein the step of supplying the compressed liquid oxygen into said plate-fin heat exchanger is performed under a condition in which load changes.

5. A production method for oxygen according to claim 1, wherein air in which the pressure exceeds the critical pressure is used as hot stream which is supplied into said plate-fin heat exchanger.

6. A production method for oxygen according to claim 1, wherein liquid oxygen obtained in a rectification column of an air separation unit is taken out from the rectification column and is compressed so that the pressure of the liquid oxygen exceeds the critical pressure.

7. A production method for oxygen comprising the steps of:

compressing liquid oxygen so that the pressure of the liquid oxygen exceeds the critical pressure;

supplying the compressed liquid oxygen into a plate-fin heat exchanger as cold stream; and heating the supplied liquid oxygen in said plate-fin heat exchanger so that the temperature of the oxygen exceeds the critical temperature, and taking out the oxygen from said plate-fin heat exchanger, wherein the liquid oxygen is compressed so that the pressure of the liquid oxygen is 8.049 MPa or higher.

8. A production method for oxygen according to claim 7, wherein liquid oxygen obtained in a rectification column of an air separation unit is taken out from the rectification column and is compressed so that the pressure of the liquid oxygen exceeds the critical pressure.

9. A production method for oxygen according to claim 7, wherein a flow rate of the oxygen in said plate-fin heat exchanger is in a range of 0.5 m/sec to 5 m/sec.

10. A production method for oxygen according to claim 7, wherein a temperature difference between hot stream and cold stream in said plate-fin heat exchanger is not more than 20° C.

11. A production method for oxygen according to claim 7, wherein the step of supplying the compressed liquid oxygen into said plate-fin heat exchanger is performed under a condition in which load changes.

12. A production method for oxygen according to claim 7, wherein air in which the pressure exceeds the critical pressure is used as hot stream which is supplied into said plate-fin heat exchanger.

13. A production method for oxygen according to claim 7, wherein liquid oxygen obtained in a rectification column of an air separation unit is taken out from the rectification column and is compressed so that the pressure of the liquid oxygen exceeds the critical pressure.

14. A production method for oxygen comprising the steps of:

compressing liquid oxygen so that the pressure of the liquid oxygen exceeds the critical pressure;

supplying the compressed liquid oxygen into a plate-fin heat exchanger as cold stream; and heating the supplied liquid oxygen in said plate-fin heat exchanger so that the temperature ofthe oxygen exceeds the critical temperature, and taking out the oxygen from said plate-fin heat exchanger, wherein a temperature difference between hot stream and cold stream in said plate-fin heat exchanger is not more than 20° C.

15. A production method for oxygen according to claim 14, wherein said plate-fin heat exchanger is a brazed aluminum plate-fin heat exchanger.

16. A production method for oxygen according to claim 14, wherein liquid oxygen obtained in a rectification column of an air separation unit is taken out from the rectification column and is compressed so that the pressure of the liquid oxygen exceeds the critical pressure.

17. A production method for oxygen according to claim 14, wherein a flow rate of the oxygen in said plate-fin heat exchanger is in a range of 0.5 m/sec to 5 m/sec.

18. A production method for oxygen according to claim 14, wherein the step of supplying the compressed liquid oxygen into said plate-fin heat exchanger is performed under a condition in which load changes.

19. A production method for oxygen according to claim 14, wherein air in which the pressure exceeds the critical pressure is used as hot stream which is supplied into said plate-fin heat exchanger.

20. A production method for oxygen according to claim 14, wherein liquid oxygen obtained in a rectification column of an air separation unit is taken out from the rectification column and is compressed so that the pressure of the liquid oxygen exceeds the critical pressure.

* * * * *